US005469639A

United States Patent [19]

Sessa

[11] Patent Number: 5,469,639

[45] Date of Patent: Nov. 28, 1995

[54] SHOE SOLE HAVING INSERT WITH GRADUATED CUSHIONING PROPERTIES

[76] Inventor: Raymond V. Sessa, 5123 Quail Crest Dr. SE., Grand Rapids, Mich. 49506

[21] Appl. No.: 349,499

[22] Filed: Dec. 2, 1994

[51] Int. Cl.[6] ..... A43B 13/18

[52] U.S. Cl. ..... 36/28; 36/30 R; 36/59 C

[58] Field of Search ..... 36/28, 30 R, 31, 36/59 C, 59 R, 114, 27, 37, 30 A, 29

[56] References Cited

U.S. PATENT DOCUMENTS

| | | | |
|---|---|---|---|
| 1,165,847 | 12/1915 | Cashman . | |
| 1,439,600 | 12/1922 | Bonawitz | 36/36 R |
| 1,559,532 | 10/1925 | Smith | 36/30 R |
| 1,751,991 | 3/1930 | Gilkerson | 36/30 A |
| 2,165,281 | 7/1939 | Uppert | 36/36 R |
| 2,597,393 | 5/1952 | Slampa | 36/36 R |
| 2,710,461 | 6/1955 | Hack | 36/59 C |
| 2,833,057 | 5/1958 | Hack . | |
| 2,930,149 | 3/1960 | Hack et al. . | |
| 2,937,462 | 5/1960 | Hack et al. . | |
| 2,941,316 | 6/1960 | Hack . | |
| 2,941,317 | 6/1960 | Hack . | |
| 2,963,800 | 12/1960 | Hack . | |
| 2,994,326 | 8/1961 | Hack . | |
| 3,005,272 | 10/1961 | Shelare et al. . | |
| 3,006,085 | 10/1961 | Bingham, Jr. | 36/59 C |
| 3,012,342 | 2/1961 | Ramirez . | |
| 3,079,707 | 3/1963 | Hack et al. . | |
| 3,079,708 | 3/1963 | Hack et al. . | |
| 3,299,544 | 1/1967 | Hack . | |
| 3,426,455 | 2/1969 | Drago | 36/3 R |
| 3,444,632 | 5/1969 | Hack et al. | 36/32 R |
| 3,507,059 | 4/1970 | Vietas | 36/59 C |
| 4,120,102 | 10/1978 | Kenigson . | |
| 4,845,863 | 7/1989 | Yung-Mao . | |
| 4,910,882 | 3/1990 | Goller | 36/44 |
| 4,974,345 | 12/1990 | Yung-Mao . | |
| 5,199,191 | 4/1993 | Moumdijian . | |
| 5,255,451 | 10/1993 | Tong et al. . | |

FOREIGN PATENT DOCUMENTS

| | | | |
|---|---|---|---|
| 1302331 | 7/1962 | France | 36/29 |
| 137555 | 10/1952 | Sweden . | |
| 1444091 | 7/1976 | United Kingdom . | |
| 8102969 | 10/1981 | WIPO | 36/29 |

*Primary Examiner*—Paul T. Sewell
*Assistant Examiner*—Ted Kavanaugh
*Attorney, Agent, or Firm*—Waters & Morse

[57] ABSTRACT

A shoe sole comprises an outsole having a recess formed in the upper surface and an insert formed of resilient material that fits in the recess. The insert has a plurality of longitudinally spaced, downwardly extending transverse ribs extending across the underside of the insert. The ribs are formed of at least two lengths, with longer ribs alternating with shorter ribs in a regular pattern along the longitudinal length of the insert. The ribs are formed in a wavy sinusoidal pattern across the width of the shoe and the individual ribs are formed in sinusoidal vertical patterns, so that each individual rib has downwardly extending portions of different lengths that repeat in a pattern across the width of the shoe. The varying lengths of the ribs provide a first cushioning rate for initial compression of the insert, while the shorter portion of the ribs provide a graduated increase in spring resistance upon further compression of the ribs.

8 Claims, 7 Drawing Sheets

SHOE SOLE HAVING INSERT WITH GRADUATED CUSHIONING PROPERTIES

BACKGROUND OF THE INVENTION

1. Field of the Invention

The present invention relates to shoe construction and more particularly to an improved sole that provides a graduated rate of cushioning.

2. Description of Prior Art

As used herein, the term "shoe" includes sandals and boots as well as other types of conventional footwear referred to commonly as shoes.

In shoe construction, a shoe "upper" that covers the foot is attached to a wear resistant "outsole" secured to the underside of the upper. An "insole", which may be contoured and may be formed of a soft foam material, fits inside the upper to provide additional cushioning for the foot. The upper may either be a moccasin type construction, wherein the upper continues under the foot or the upper can terminate at the edge of the sole and be bonded around the periphery of the sole. In the latter case, the upper typically is cemented to a thin fibrous insole board when the upper is formed or lasted and the outsole is mounted on the underside of the insole board.

The construction of the outsole generally represents a compromise between wear characteristics and comfort. A harder, less resilient wear surface is desired in order to provide long shoe life, whereas a softer, more resilient sole is more comfortable but tends to have less satisfactory wear characteristics. In some shoes, the problem is resolved by providing a thin, wear resistant surface on a bottom of an otherwise soft and resilient portion of the sole called a midsole. This construction is frequently used for sports shoes or running shoes and generally results in a rather thick sole. In applicant's co-pending patent application, Ser. No. 08/191,024, filed Feb. 2, 1994, applicant describes a sole construction, wherein an insert formed of more resilient material fits in a recess in an outsole, with oppositely inclined forward and rearward ribs on the insert providing varying cushioning characteristics for the heel and fore-parts of the foot. Other patents, such as Yung-Mao U.S. Pat. No. 4,974,345, disclose other types of inserts or midsoles that are designed to improve foot comfort.

In a shoe, different levels of cushioning are desirable. When a foot is initially pressed downwardly on a shoe sole, a relatively soft and more easily deformed cushioning effect is desirable. However, if the foot is driven hard downwardly into the sole, it is desirable that the spring characteristics of the shoe become more stiff so that the cushioning does not completely bottom out.

An object of the present invention is to provide a shoe construction with improved cushioning characteristics that provide a graduated rate of cushioning in a relatively thin sole.

SUMMARY OF THE INVENTION

In accordance with the present invention, a shoe sole comprises an outsole having lower and upper surfaces, with a recess being formed in the upper surface. An insert formed of resilient material fits in the recess in the outsole and has a plurality of longitudinally spaced, downwardly extending transverse ribs extending across the underside of the insert. The ribs are formed of at least two lengths, with longer ribs alternating with shorter ribs in a regular pattern along the longitudinal length of the insert. The longer ribs terminate in distal ends that rest on the bottom surface of the outsole recess, while the shorter ribs terminate in distal ends that are spaced above the bottom surface of the outsole recess when in an uncompressed condition. The longer ribs provide a first cushioning rate for initial compression of the insert, while the shorter ribs provide a graduated increase in spring resistance upon further compression of the ribs, so as to provide a stiffer spring or cushioning effect upon further compression of the sole.

The ribs of the present invention are formed in a wavy sinusoidal pattern across the width of the shoe and the individual ribs are formed in sinusoidal vertical patterns, so that each individual rib has downwardly extending portions of different lengths that repeat in a pattern across the width of the shoe.

The insert ribs fit in a recess in the outsole, so that ribs are not exposed on the outside of the shoe. This provides all the comfort of cushioning ribs without exposing the ribs to wear and to picking up dirt and debris. The insert can thus be formed of a more resilient and soft material than the harder outsole. Polyurethane is a particularly desirable material.

The insert is held in place without adhesive by mating downwardly and outwardly tapered side edges on the recess and insert.

These and other features and advantages of the present invention will hereinafter appear in connection with a detailed description of a preferred embodiment of the present invention set forth below and shown in the attached drawings.

DETAILED DESCRIPTION OF PREFERRED EMBODIMENT

Figure 1:
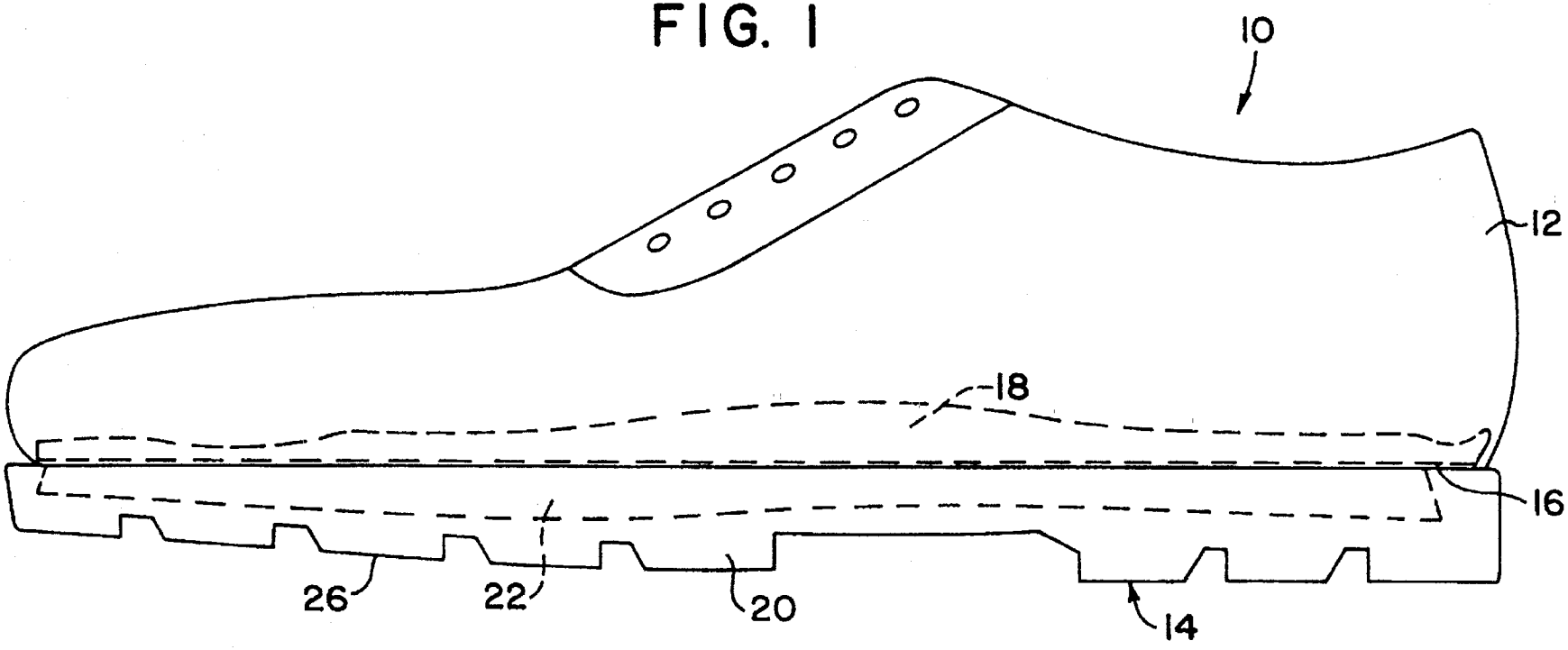
FIG. 1 is a side elevation of a shoe showing the outsole of the present invention mounted on a conventional shoe upper.
Figure 4:
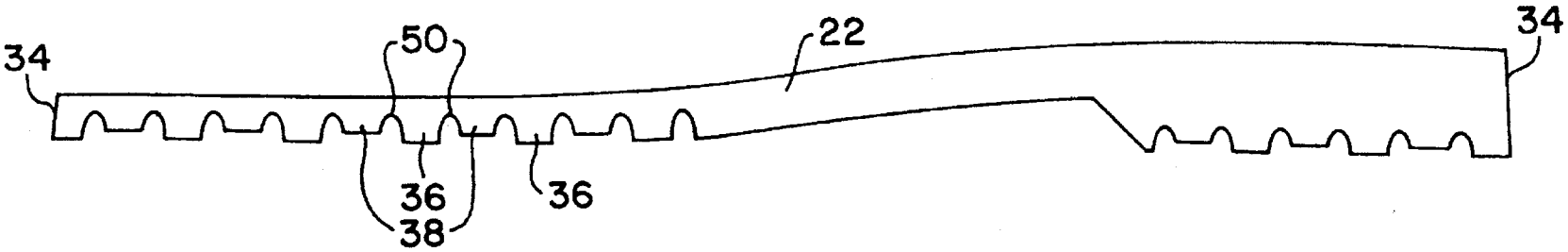
FIG. 4 is a side elevational view showing the insert of the present invention.
Figure 3:
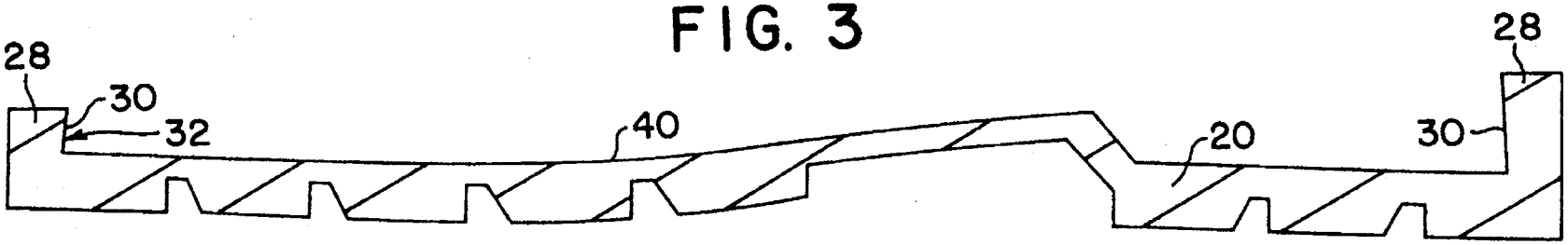
FIG. 3 is a side elevational view showing the outsole of the present invention.

Referring now to the drawings and more particularly to FIG. 1, a shoe 10 comprises an upper 12 mounted on an outsole assembly 14. For convenience, the upper is shown as a conventional shoe upper. However, the footwear could be a shoe, boot, sandal or the like, and the upper could vary accordingly.

In the shoe construction of FIG. 1, a layer of material 16 is positioned between the upper and the outsole assembly. The layer of material could be a portion of the upper material in moccasin type construction or it could be a fibrous insole board in conventional welt construction or the like. An insole formed of a soft cushioned foam material fits inside the upper and may be contoured to the shape of the foot. The insole may be removable.

Figure 2:
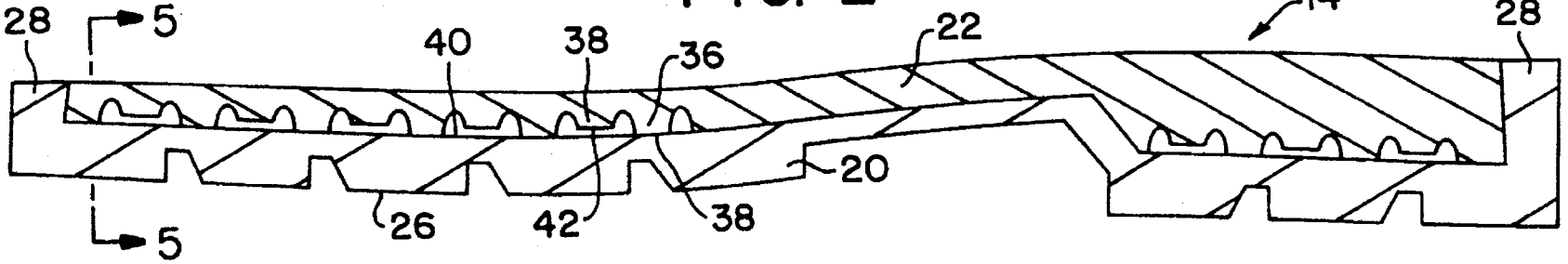
FIG. 2 is a side elevational cross-sectional view of the outsole assembly of the present invention.
Figure 7:
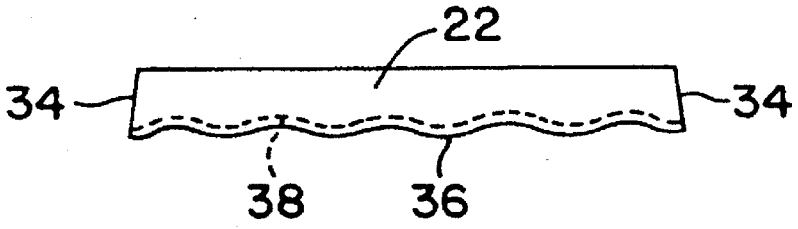
FIG. 7 is a front elevational cross-sectional view of the insert shown in FIG. 5.

Referring to FIG. 2, outsole assembly 14 comprises an outsole itself 20 and an insert 22 that is mounted in a recess 24 in the outsole. Outsole 20 has a lower surface 26 formed with a suitable tread pattern. The outsole can be of conventional thickness.

Outsole 20 comprises a recess 24 in the interior of the outsole, with a rim 28 extending around the periphery of the outsole recess. The rim has a downwardly and outwardly tapered interior surface 30 that causes the bottom 32 of the recess to be wider than the top of the recess.

In the present invention, outsole 20 is preferably made from a thermoplastic rubber or TPR. TPR is formed by heating the substance past its melting point and then injecting it into a mold. As the substance cools, it hardens into the shape of the mold. TPR has very little air intermixed with the substance. The density of the material is on the order of 85% to 90%. Outsole 20 could be made of a variety of materials, including polyvinylchloride. However, it is preferably made from TPR having a durometer hardness of 60–64 on the Shore type A scale. The Shore type A scale varies from 0–100 with 0 representing no hardness and 100 representing the hardness of steel. TPR with a 60–64 durometer hardness has the preferred resiliency and abrasion resistance.

Figure 5:
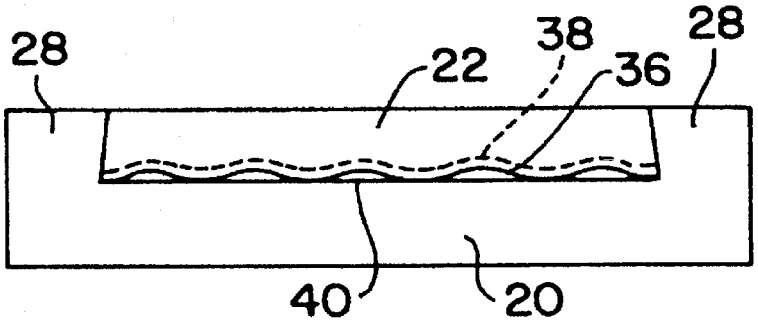
FIG. 5 is a transverse sectional view of the outsole assembly of the present invention taken along line 5—5 of FIG. 2.
Figure 8:
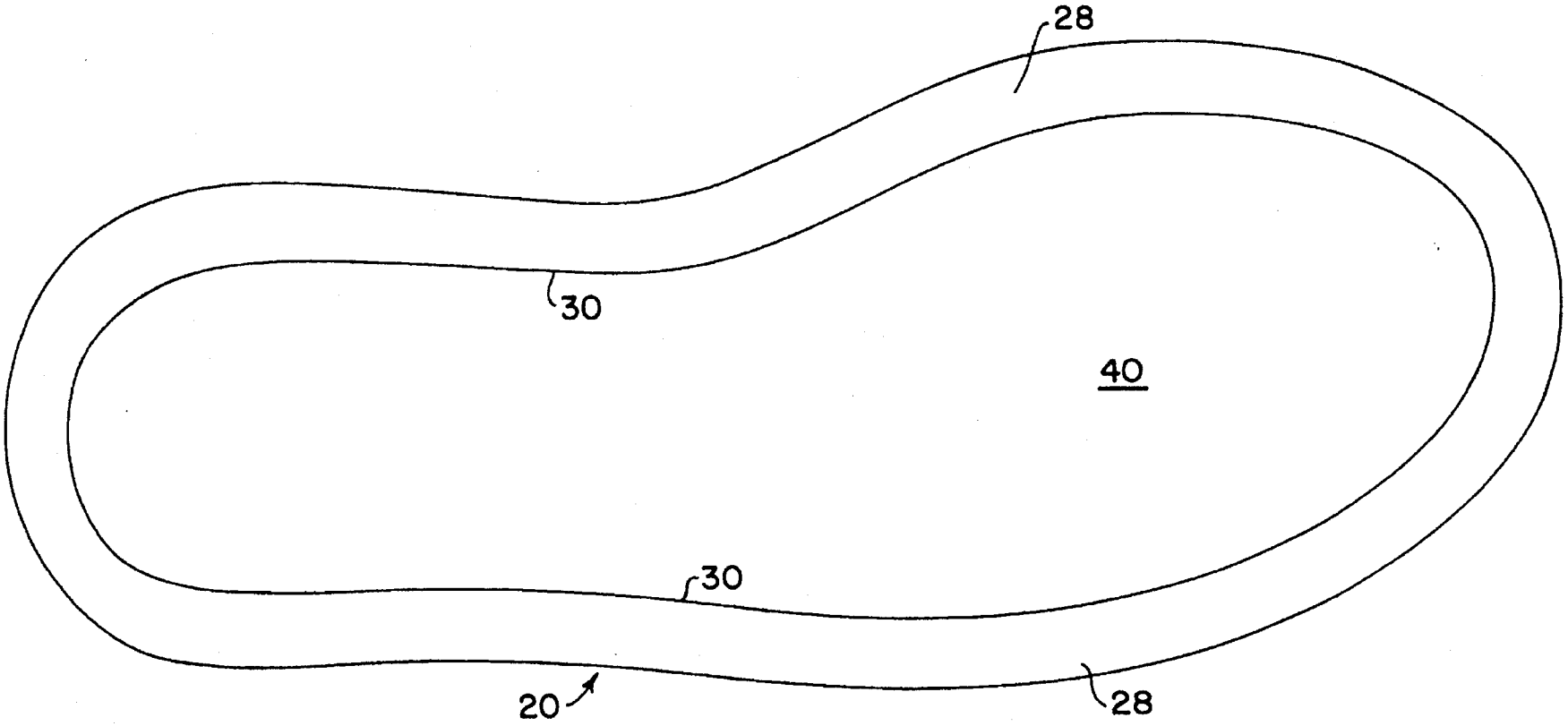
FIG. 8 is a top plan view of the outsole of the present invention.
Figure 9:
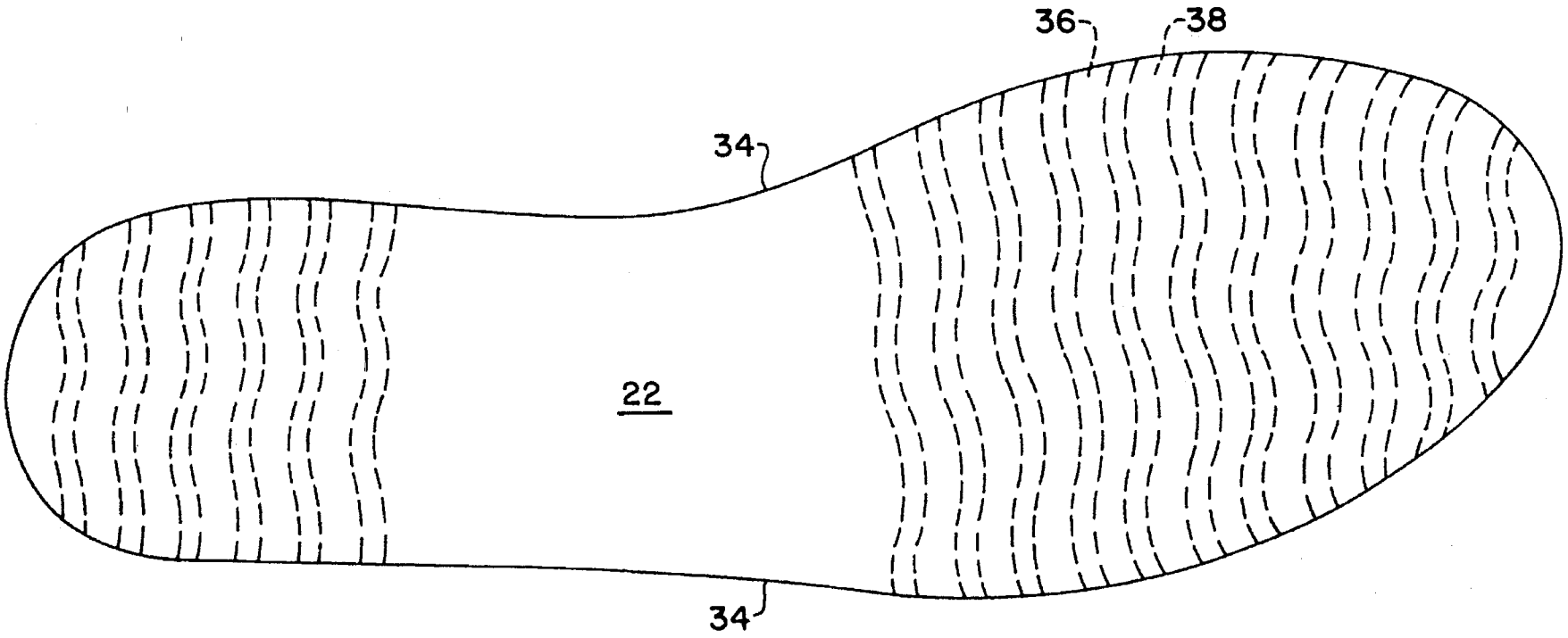
FIG. 9 is a top plan view of the insole of the present invention.
Figure 10:
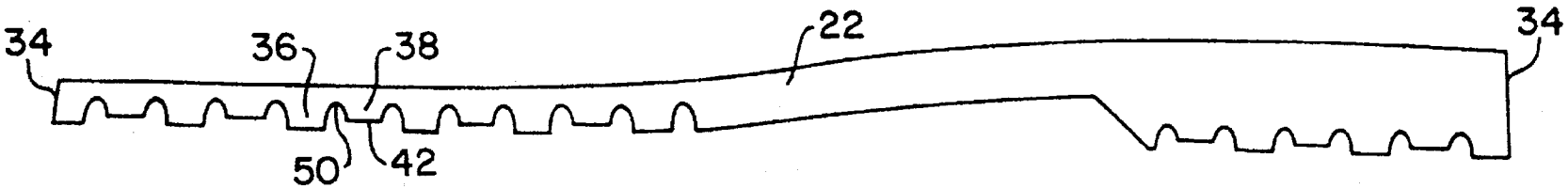
FIG. 10 is a side elevational view of the insert of the present invention.

As shown in FIG. 5, insert 22 fits snugly in recess 24 in the outsole, with the insert having downwardly and outwardly tapering side walls 34 that mate with interior side walls 30 of the recess. The insert can be deformed or bent sufficiently so that the insert fits inside the tapered opening in the recess. The engagement of the tapered walls serves a wedging function urging the insert downwardly into the recess and preventing the insert from slipping out of the recess, all without the necessity of any adhesive to hold the insert in place.

Insert 22 comprises a generally flater upper surface, although in the context of the present invention, the flat surface is contemplated to be a surface having the gentle smooth curved shape as shown in the drawings.

The underside of insert 22 comprises a series of longitudinally spaced transverse ribs 36 and 38, with ribs 36 being longer than ribs 38. The distal ends of ribs 36 extend downwardly into contact with a generally planer or flat upper surface 40 of the outsole recess, while distal ends 42 of shorter ribs 38 are spaced apart from the bottom surface 40 of the recess. Ribs 36 and 38 alternate longitudinally along the length of the insert, with the ribs being present at least in the heel and forepart portions of the sole.

Figure 11:
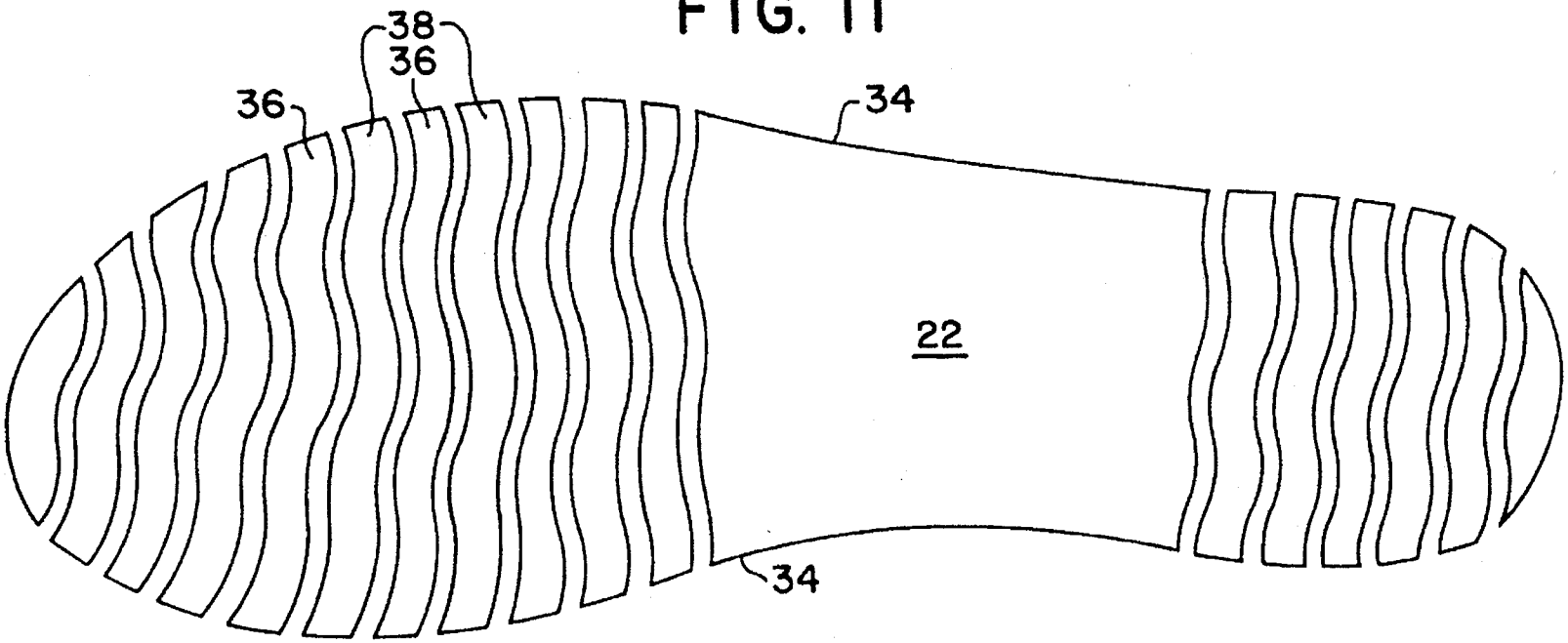
FIG. 11 is a bottom plan view of the insert of the present invention.
Figure 12:
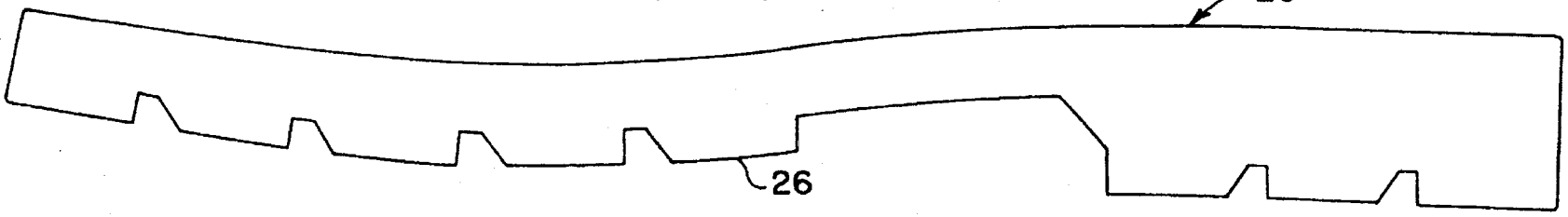
FIG. 12 is a side elevational view of the outsole of the present invention.
Figure 13:
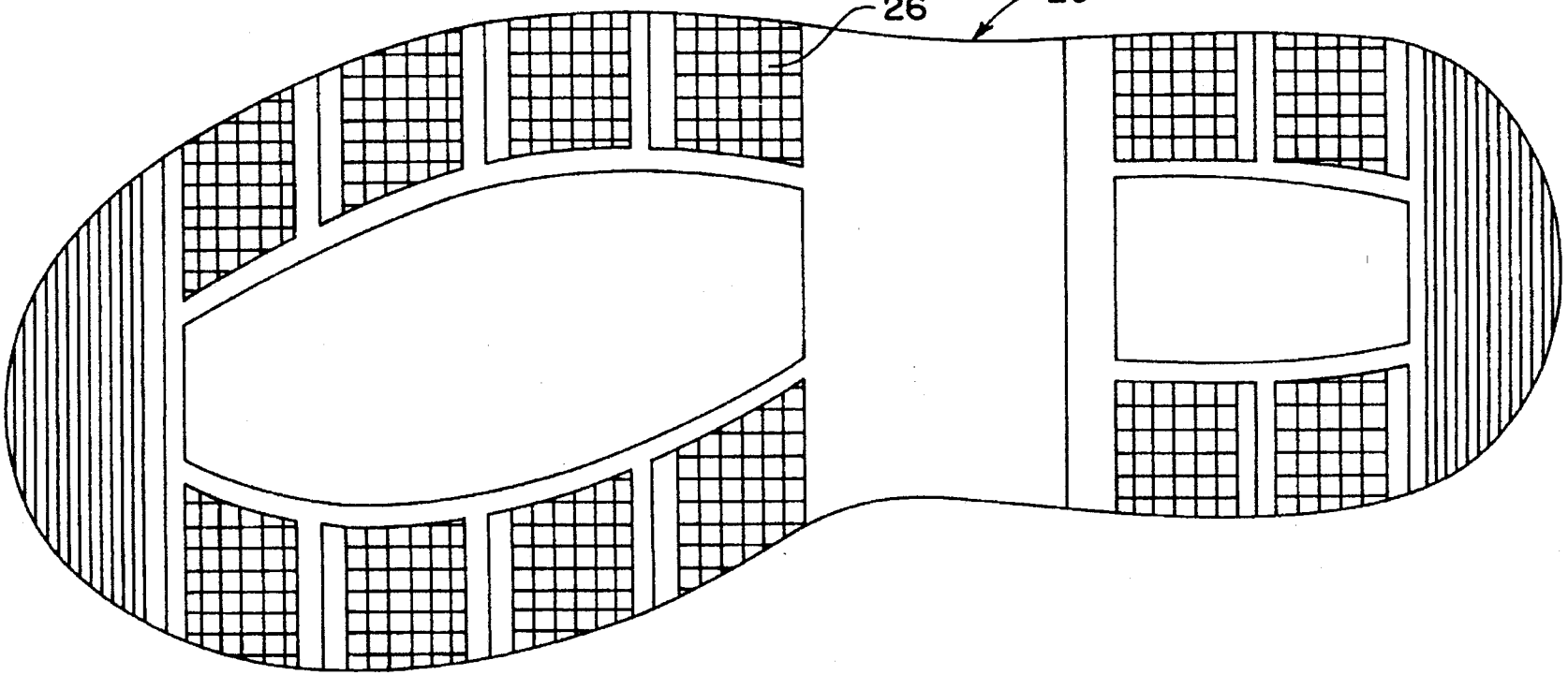
FIG. 13 is a bottom plan view of the outsole of the present invention.

As shown in FIG. 11, the insert ribs have a wavy sinusoidal shape as they extend transversely across the surface of the insert. This provides improved cushioning.

Figure 6:
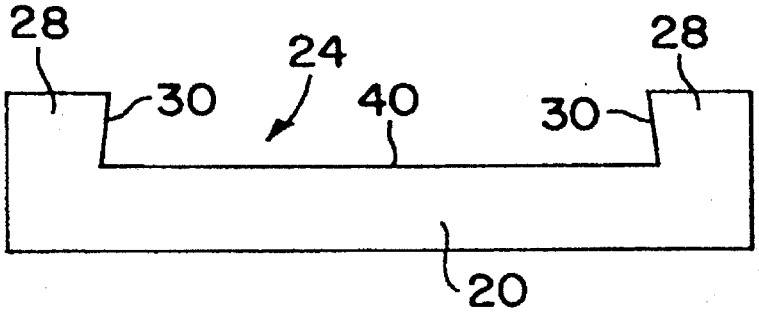
FIG. 6 is a front elevational view of the outsole shown in FIG. 5.

As shown in FIG. 5 and 6, the distal or bottom surfaces of ribs 36 and 38 are individually formed in a transverse sinusoidal wave form extending transversely across the insert, such that alternating portions of the individual ribs extend downwardly further than other portions in a predetermined pattern.

Insert 22 may be made from a variety of materials, including TPR, but is preferably made from closed cell polyurethane. Polyurethane is made from a combination of separate liquids which react: to form a polyurethane foam. Polyurethane resembles bread, in that a foam interior is surrounded at the periphery by a polyurethane "crust" or "skin". This skin is substantially harder than the interior foam, which makes testing in terms of durometer impractical.

When polyurethane has a closed cell configuration, the characteristics are usually measured as a percentage of weight to volume or density. The closed cell configuration indicates that the foam includes a plurality of encapsulated air pockets which do not communicate air with other air pockets. For insert 22, the preferred density of closed cell polyurethane is on the order of 53–57 percent.

The insole, on the other hand, can be a conventional elastic foam insole formed of a lighter weight polyurethane in an open cell construction, in order to provide absorbency. Such an insoles provides a soft, cushioned feel and conforms to the foot. The insole can be softer and more compressible and deformable than the insert, which does not have to conform with the shape of the foot to the same extent as the insole. An insole board provides some insolation between the outsole insert and the insole.

In the present invention, shorter ribs 38 are about one-sixteenth inch shorter than longer ribs 36, so that when the distal end 48 of rib 36 is in contact with surface 40 in the recess, distal end 42 of shorter rib 38 is positioned about one-sixteenth inch from surface 40.

The longitudinal thickness of the ribs is about one-quarter inch at the distal end 42 of shorter rib 38. A rounded or contoured grooves 50 is positioned between adjacent longitudinal ribs 36 and 38, with the upper surface of grooves 50 being rounded, and with the upper surface of the grooves being about three-sixteenths inches from the distal end of the longer rib 36.

Refer ring to FIG. 5, the sinusoidal bottom surface of the individual ribs causes alternating portions of each of these ribs to be raised above the surface 40 of the recess when the insert is in an uncompressed position. This distance can be about one-sixteenth inch.

The insert construction of the present invention provides a number of advantages. The spaces between the ribs permit sideways expansion of the compressed insert material when the insert is compressed, thus increasing the resilience of the material at the point where the ribs are located.

Another important advantage of the rib construction of the present invention is that the ribs, being of varied lengths, both longitudinally and transversely, provide a graduated cushioning characteristic to the sole. As stated above, it is desirable to have a softer cushioning action for initial compression of the shoe sole and then have the compressibility decrease so that the spring action does not bottom out as the compression of the sole continues. The sole of the present invention provides this advantage by the graduated lengths of ribs 36 and 38.

As the insert is initially compressed, the spring rate or compression resilience of the insert is provided solely by ribs 36 and only by those portions of the ribs that are in contact with surface 40 of the recess. As the insert is further compressed, the remaining portions of each rib come in contact with surface 40, as do the distal ends 42 of ribs 38. When this occurs, further compression of the insert requires compression of ribs 38 as well as ribs 36, across the entire width of the ribs. This alters the spring rate of the insert and provides greater resistance to further compression of the insert.

The advantage of this construction is that for light compression of the insert, the insert provides a light cushiony feel. However, when the foot strikes the ground hard, the spring stiffness of the insert increases so that the insert provides increased resistance to compression of the insert. The user thus gets the benefit of the softer feel of an insert without having the insert so soft that the cushioning effect bottoms out when the foot strikes the ground hard. The convolutions in the ribs as they extend in a sideways direction and the convolutions on the bottom surfaces of the ribs provide an even distribution of graduated cushioning characteristics across the bottom of the foot and in addition provide in essence a two-stage cushioning. The distal ends of the longer ribs first compress until the entire rib surface engages surface 40 of the recess and then the shorter ribs 38 compress until the entire transverse surface of those ribs comes in contact with surface 40. Thereafter, the entire surfaces of both types of ribs are compressed simultaneously, providing more resistance to compression.

A shoe constructed with the foregoing outsole has the advantage of a durable wear-resistant sole while at the same time maintaining the benefits of a softer, more cushiony and resilient foot contact surface. These advantages are achieved without the use of complex midsoles (as is common in sports shoes) and without the extra sole thickness common with sports shoes having outsoles laminated on top of midsoles. The wedge-shaped construction of the insert and outsole recess also permits the insert to move independently in the outsole recess as the foot is pressed down on the sole. Since the insert and outsole are formed of materials having different compression characteristics, an adhesive joint would be strained by the action of a foot exerting a compressing force on the sole.

It should be understood that the foregoing is merely representative of the preferred practice of the present invention and that various changes and modifications may be made in the arrangements and details of construction of the invention without departing from the spirit and scope of the present invention, as defined in the appended claims.

I claim:

1. A shoe sole comprising:

an outsole having lower and upper surfaces, with a recess being formed in the upper surface, the interior of the recess comprising a generally flat bottom surface; and an insert formed of a resilient material that fits in the recess in the outsole, the insert having an insert bottom that rests on the bottom surface of the outsole recess, the insert bottom comprising a plurality of longitudinally spaced, downwardly extending, transverse ribs, the ribs being of at least two lengths so as to include longer and shorter ribs, the longer ribs alternating with the shorter ribs in a regular pattern along the longitudinal length of the insert, the longer ribs terminating in distal ends that rest on the bottom surface of the outsole recess, the shorter ribs terminating in distal ends that are raised above and spaced away from said bottom surface when the insert is in an uncompressed condition, the insert thus providing a variable cushioning rate for a user's foot, the longer ribs providing a first cushioning rate for initial compression of the insert, the shorter ribs providing supplemental cushioning when the longer ribs are compressed to the point where the shorter ribs engage the bottom surface, thus providing a stiffer second cushioning rate for further compression of the insert, the variable cushioning rates providing a soft feel on initial compression and a stronger resistance to compression upon further compression of the insert, at least some of the transverse ribs being formed with alternating portions of different lengths as the ribs extend from one side to the other side of the insert, the different length portions of the individual ribs providing a graduated cushioning rate for the individual ribs.

2. A shoe sole according to claim 1 wherein the transverse ribs are formed in a sinusoidal wave pattern.

3. A shoe sole according to claim 1 wherein the variable length bottom portions of the ribs are formed in a sinusoidal pattern, and the ribs themselves are formed in a sinusoidal wave pattern as they extend from side to side transversely across the insert.

4. A shoe sole according to claim 1 wherein the shorter ribs are about one-sixteenth of an inch shorter than the longer ribs.

5. A shoe sole according to claim 4 wherein the longer ribs are about three-sixteenths of an inch long.

6. A shoe sole according to claim 5 wherein the shorter ribs are about one-quarter inch wide at their distal ends.

7. A shoe sole according to claim 1 wherein the insert and outsole are formed of resilient natural or synthetic resins, with the insert being formed of polyurethane and being a softer, more cushioning material than the outsole.

8. A shoe sole according to claim 1 wherein the outsole includes an outer peripheral rim that surrounds the insert, the rim having an interior surface that is wider at the bottom than the top, with the insert having similarly shaped outer peripheral side edges, such that the insert is held in the recess by the engagement of the insert side edges with the outsole rim, without the insert being adhesively attached to the outsole.

* * * * *